US010239328B2

(12) United States Patent
Buchar et al.

(10) Patent No.: US 10,239,328 B2
(45) Date of Patent: Mar. 26, 2019

(54) SYSTEM FOR PRINTING ON THREE-DIMENSIONAL (3D) OBJECTS

(71) Applicant: Xerox Corporation, Norwalk, CT (US)

(72) Inventors: Wayne A. Buchar, Bloomfield, NY (US); James J. Spence, Honeoye Falls, NY (US); Jack G. Elliot, Penfield, NY (US); Michael F. Leo, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/704,434

(22) Filed: Sep. 14, 2017

(65) Prior Publication Data

US 2018/0001662 A1 Jan. 4, 2018

Related U.S. Application Data

(63) Continuation of application No. 15/163,880, filed on May 25, 2016, now Pat. No. 9,827,784.

(51) Int. Cl.

| | |
|---|---|
| ***B41J 3/407*** | (2006.01) |
| ***B41J 2/045*** | (2006.01) |
| ***B41J 3/54*** | (2006.01) |
| ***B41J 11/06*** | (2006.01) |
| ***A63B 45/02*** | (2006.01) |

(52) U.S. Cl.

CPC ..... *B41J 3/4073* (2013.01); *A63B 45/02* (2013.01); *B41J 2/04501* (2013.01); *B41J 3/543* (2013.01); *B41J 11/06* (2013.01); *B41J 3/4078* (2013.01)

(58) Field of Classification Search

CPC ..... B41J 3/4073; B41J 3/543; B41J 3/4078; B41J 2/04501; B41J 11/06; A65B 45/02

See application file for complete search history.

(56) References Cited

U.S. PATENT DOCUMENTS

| | | | |
|---|---|---|---|
| 8,511,782 | B2 | 8/2013 | Chang et al. |
| 9,217,090 | B2 | 12/2015 | Donohoe et al. |
| 2002/0134257 | A1 | 9/2002 | Stephenson |
| 2002/0191036 | A1 | 12/2002 | Park |
| 2005/0179721 | A1 | 8/2005 | Jones et al. |

(Continued)

FOREIGN PATENT DOCUMENTS

DE 102010034780 A1 * 2/2012 ..... B41F 15/0872

*Primary Examiner* — Sharon A. Polk

(74) *Attorney, Agent, or Firm* — Maginot Moore & Beck LLP

(57) ABSTRACT

A printing system facilitates the printing of articles of manufacture. The system includes an array of printheads, a support member positioned to be parallel to a plane formed by the array of printheads, a member movably mounted to the support member, an actuator operatively connected to the movably mounted member, an object holder configured to mount to the movably mounted member, and a controller operatively connected to the plurality of printheads and the actuator. The controller is configured to operate the actuator to move the object holder past the array of printheads and to operate the plurality of printheads to eject marking material onto objects held by the object holder as the object holder passes the array of printheads. The support member and printhead array are oriented vertically to enable the printing system to be installed in a vertical cabinet that provides a small footprint in a non-production environment.

21 Claims, 13 Drawing Sheets

(56) References Cited

U.S. PATENT DOCUMENTS

| | | | | |
|---|---|---|---|---|
| 2012/0062628 | A1* | 3/2012 | Nagai | B41J 2/16517 347/9 |
| 2015/0158310 | A1 | 6/2015 | Olejniczak et al. | |
| 2015/0224765 | A1 | 8/2015 | Fukasawa | |
| 2015/0273864 | A1 | 10/2015 | Moehringer et al. | |

* cited by examiner

SYSTEM FOR PRINTING ON THREE-DIMENSIONAL (3D) OBJECTS

PRIORITY CLAIM

This application claims priority from and is a continuation application of U.S. patent application Ser. No. 15/163,880, which is entitled "System For Printing On Three-Dimensional (3D) Objects," while was filed on May 25, 2016, and which issued as U.S. Pat. No. 9,827,784 on Nov. 28, 2017.

TECHNICAL FIELD

This disclosure relates generally to a system for printing on three-dimensional (3D) objects, and more particularly, to systems for printing such objects in a non-production environment.

BACKGROUND

Commercial article printing typically occurs during the production of the article. For example, ball skins are printed with patterns or logos prior to the ball being completed and inflated. Consequently, a non-production establishment, such as a distribution site, which customizes products, for example, in region in which potential product customers support multiple professional or collegiate teams, needs to keep an inventory of products bearing the logos of the various teams. Ordering the correct number of products for each different logo to maintain the inventory can be problematic.

One way to address these issues in non-production outlets would be to keep unprinted versions of the products, and print the patterns or logos on them at the distribution site. Adapting known printing techniques, such as two-dimensional (2D) media printing technology, to apply image content onto three-dimensional objects would be difficult. Since the surfaces to be printed have to be presented to the printheads as relatively flat, two-dimensional surfaces, the objects have to be maneuvered carefully to present portions of the articles as parallel planes to the printheads. Therefore, printing systems capable of being operated in non-production environments that can print 3D objects are unknown, but desirable.

SUMMARY

A new printing system is configured to print images on 3D objects in a non-production environment. The printing system includes a plurality of printheads arranged in a two-dimensional array, each printhead being configured to eject marking material, a support member positioned to be parallel to a plane formed by the two-dimensional array of printheads, a member movably mounted to the support member, an actuator operatively connected to the movably mounted member to enable the actuator to move the moveably mounted member along the support member, an object holder configured to mount to the movably mounted member to enable the object holder to pass the array of printheads as the moveably mounted member moves along the support member, and a controller operatively connected to the plurality of printheads and the actuator, the controller being configured to operate the actuator to move the object holder past the array of printheads and to operate the plurality of printheads to eject marking material onto objects held by the object holder as the object holder passes the array of printheads.

BRIEF DESCRIPTION OF THE DRAWINGS

The foregoing aspects and other features of a printing system that prints images on 3D objects are explained in the following description, taken in connection with the accompanying drawings.

DETAILED DESCRIPTION

Figure 1:
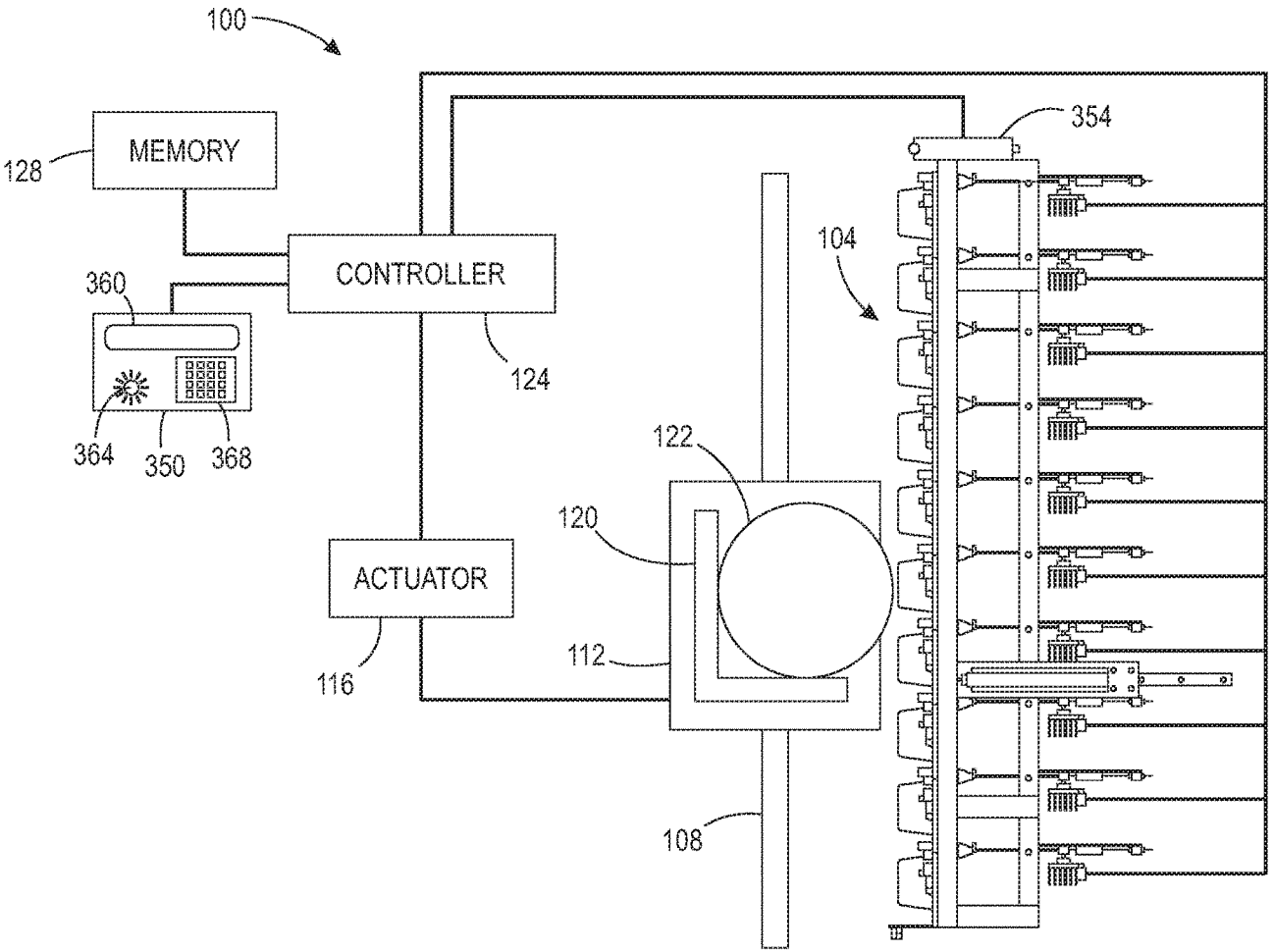
FIG. 1 illustrates an exemplary printing system 100 configured to print on a 3D object.

For a general understanding of the present embodiments, reference is made to the drawings. In the drawings, like reference numerals have been used throughout to designate like elements.

FIG. 1 illustrates an exemplary printing system 100 configured to print on a 3D object. The printing system 100 includes an array of printheads 104, a support member 108, a member 112 movably mounted to the support member 108, an actuator 116 operatively connected to the movably mounted member 112, an object holder 120 configured to mount to the movably mounted member 112, and a controller 124 operatively connected to the plurality of printheads and the actuator. As shown in FIG. 1, the array of printheads 104 is arranged in a two-dimensional array, which in the figure is a 10×1 array, although other array configurations can be used. Each printhead is fluidly connected to a supply of marking material (not shown) and is configured to eject marking material received from the supply. Some of the printheads can be connected to the same supply or each printhead can be connected to its own supply so each printhead can eject a different marking material. The controller 124 is also operatively connected to an optical sensor 350.

The support member 108 is positioned to be parallel to a plane formed by the array of printheads and, as shown in the figure, is oriented so one end of the support member 108 is at a higher gravitational potential than the other end of the support member. This orientation enables the printing system 100 to have a smaller footprint than an alternative embodiment that horizontally orients the array of printheads and configures the support member, movably mounted member, and object holder to enable the object holder to pass objects past the horizontally arranged printheads so the printheads can eject marking material downwardly on the objects.

The member 112 is movably mounted to the support member 108 to enable the member to slide along the support member. In some embodiments, the member 112 can move bi-directionally along the support member. In other embodiments, the support member 108 is configured to provide a return path to the lower end of the support member to form a track for the movably mounted member. The actuator 116 is operatively connected to the movably mounted member 112 so the actuator 116 can move the moveably mounted member 112 along the support member 108 and enable the object holder 120 connected to the moveably mounted member 112 to pass the array of printheads 104 in one dimension of the two-dimensional array of printheads. In the embodiment depicted in the figure, the object holder 120 moves an object 122 along the length dimension of the array of printheads 104.

The controller 124 is configured with programmed instructions stored in a memory 128 operatively connected to the controller so the controller can execute the programmed instructions to operate components in the printing system 100. Thus, the controller 124 is configured to operate the actuator 116 to move the object holder 120 past the array of printheads 104 and to operate the array of printheads 104 to eject marking material onto objects held by the object holder 120 as the object holder passes the array of printheads 104. Additionally, the controller 124 is configured to operate the inkjets within the printheads of the array of printheads 104 so they eject drops with larger masses than the masses of drops ejected from such printheads. In one embodiment, the controller 124 operates the inkjets in the printheads of the array of printheads 104 with firing signal waveforms that enable the inkjets to eject drops that produce drops on the object surfaces having a diameter of about seven to about ten mm. This drop size is appreciably larger than the drops that produced drops on the material receiving surface having a mass of about 21 ng.

The system configuration shown in FIG. 1 is especially advantageous in a number of aspects. For one, as noted above, the vertical configuration of the array of printheads 104 and the the support member 108 enables the system 100 to have a smaller footprint than a system configured with a horizontal orientation of the array and support member. This smaller footprint of the system enables the system 100 to be housed in a single cabinet 180, as depicted in FIG. 2C, and installed in non-production outlets. Once installed, various object holders, as described further below, can be used with the system to print a variety of goods that are generic in appearance until printed. Another advantageous aspect of the system 100 shown in FIG. 1 is the gap presented between the objects carried by the object holder 120 and the printheads of the array of printheads 104. The gap in this embodiment is in a range of about five to about six mm. Heretofore, the gap was maintained in a range centered about 1 mm. This smaller gap was thought to ensure a more accurate placement of drops from an ejecting printhead. Applicants have discovered that the greater gap width reduces the effect of laminar air flow in the gap between the printheads and the surface receiving the marking material drops so the accuracy of drop placement, especially for larger 3D objects, is maintained. This effect is particularly effective with the larger drop sizes noted previously. Without the turbulence produced by the movement of an object in close proximity to a printhead, the momentum of the ejected drops is adequate to keep the drops on their projected course so the registration of the drops from different printheads can be preserved for maintaining image quality. Additionally, the controller 124 can be configured with programmed instructions to operate the actuator 116 to move the object holder at speeds that attenuate the air turbulence in the larger gap between the printhead and the object surface used in the system 100.

Figure 2A:
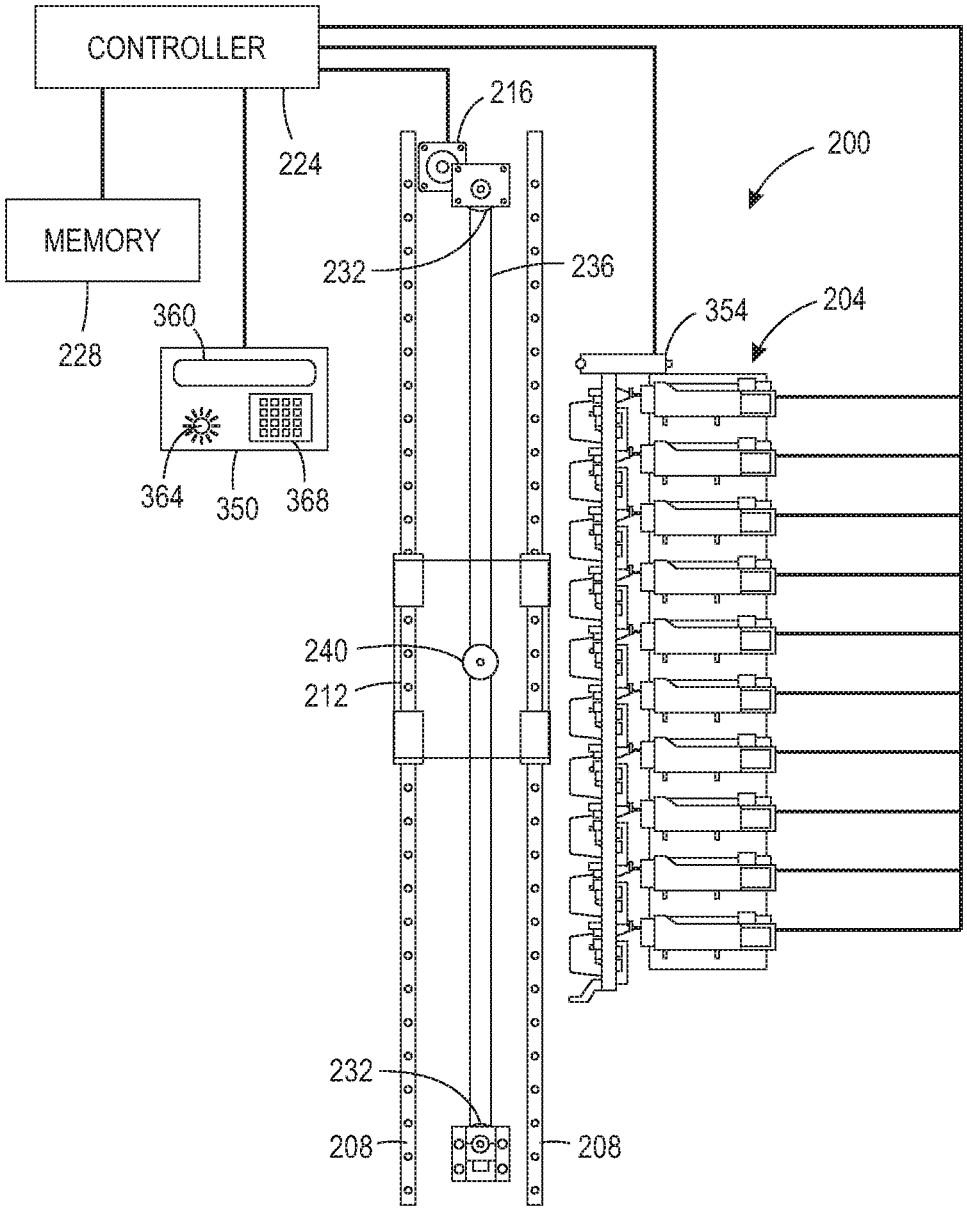
FIG. 2A and FIG. 2B are other embodiments of the system 100 that use a double support member to enable movement of objects past an array of printheads.

An alternative embodiment of the system 100 is shown in FIG. 2A. In this alternative embodiment 200, the support member is a pair of support members 208 about which the moveably mounted member 212 is mounted. This embodiment includes a pair of fixedly positioned pulleys 232 and a belt 236 entrained about the pair of pulleys to form an endless belt. The moveably mounted member 212 includes a third pulley 240 that engages the endless belt to enable the third pulley 240 to rotate in response to the movement of the endless belt moving about the pair of pulleys 232 to move the moveably mounted member and the object holder 220. In this embodiment, the actuator 216 is operatively connected to one of the pulleys 232 so the controller 224 can operate the actuator to rotate the driven pulley and move the endless belt about the pulleys 232. The controller 224 can be configured with programmed instructions stored in the memory 228 to operate the actuator 216 bi-directionally to rotate one of the pulleys 232 bi-directionally for bi-directional movement of the moveably mounted member 212 and the object holder 220 past the array of printheads 204. In another alternative embodiment shown in FIG. 2B, one end of the belt 236 is operatively connected to a take-up reel 244 that is operatively connected to the actuator 216. The other end of the belt 236 is fixedly positioned. The controller 224 is configured with programmed instructions stored in the memory 228 to enable the controller 224 to operate the actuator 216 to rotate the take-up reel 244 and wind a portion of the length of the belt about the take-up reel 244. The belt 244 also engages a rotatable pulley 248 mounted to the moveably mounted member 212. Since the other end of the belt 236 is fixedly positioned, the rotation of the reel 244 causes the moveably mounted member 212 to move the object holder past the array of printheads. When the controller 224 operates the actuator 216 to unwind the belt from the reel 224, the moveably mounted member 212 descends and enables the object holder to descend past the array of printheads 204. This direction of movement is opposite to the direction in which the object holder moved when the actuator was operated to take up a length of the belt 236. These configurations using a belt to move the moveably mounted member differ from the one shown in FIG. 1 in which the controller 124 operates a linear actuator to move the moveably mounted member 112 and the object holder 120 bi-directionally past the array of printheads.

Figure 3A:
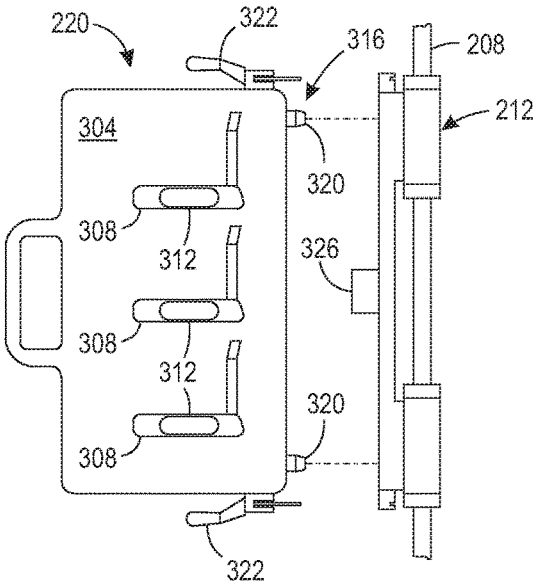
FIG. 3A to FIG. 3D depict details of the object holder and the moveably mounted member shown in FIG. 2A and FIG. 2B.

An example of an object holder 220 is shown in FIG. 3A. The object holder 220 includes a plate 304 having apertures 308 in which objects 312, which are golf club heads in the figure, are placed for printing. A latch 316 is configured for selectively mounting the object holder 220 to the movably mounted member 212. The latch 316 includes locating features 320 to aid in properly positioning the object holder 220 for securing the holder to the member 212, which is supported by members 208 as shown in FIG. 2A. Once properly positioned, levers 322 operate the latch 316 to secure the holder 220 to the member 212. As shown in the figure, member 212 includes an input device 326 for obtaining an identifier from the object holder 220 as further described below.

Figure 2B:
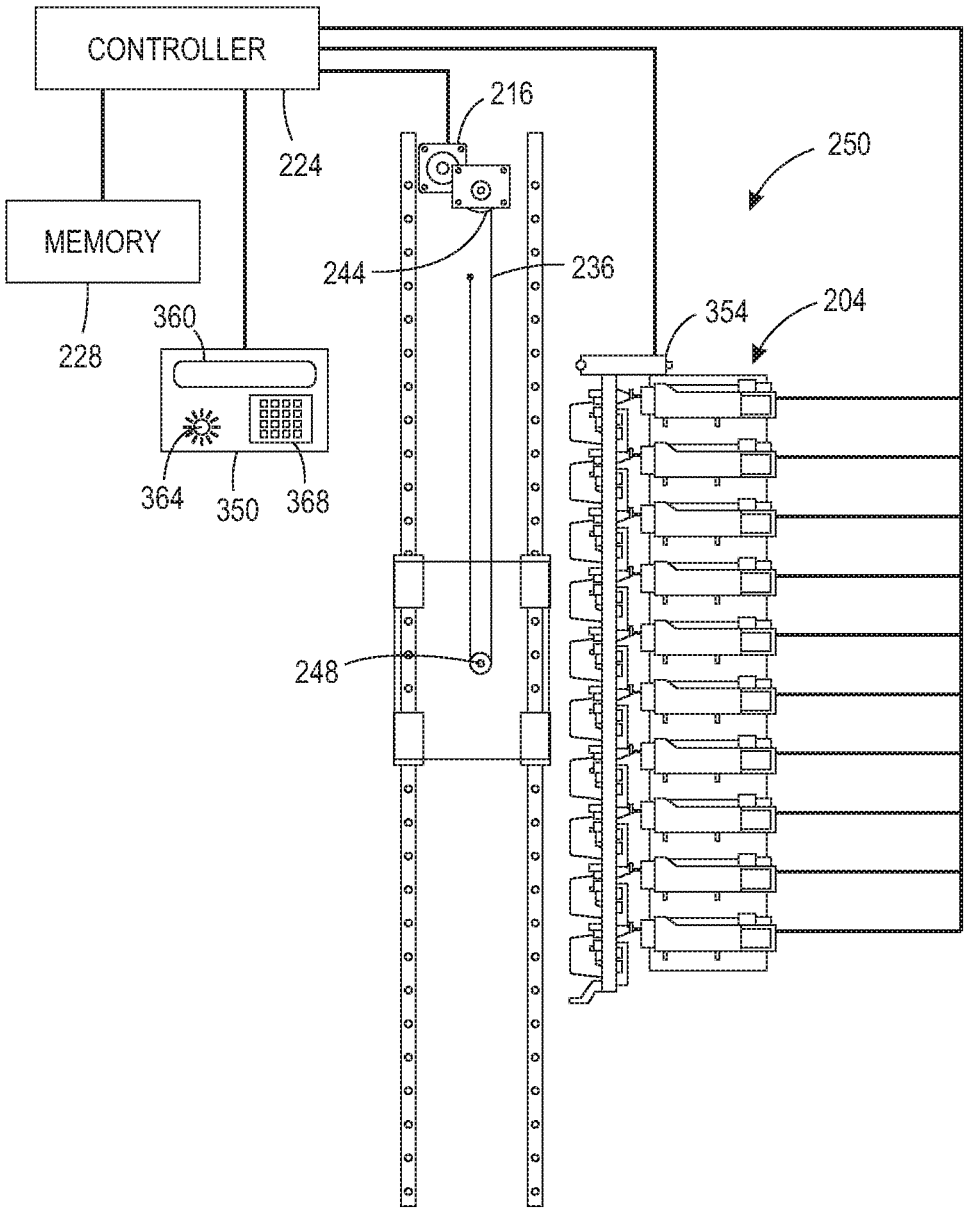
Figure 3B:
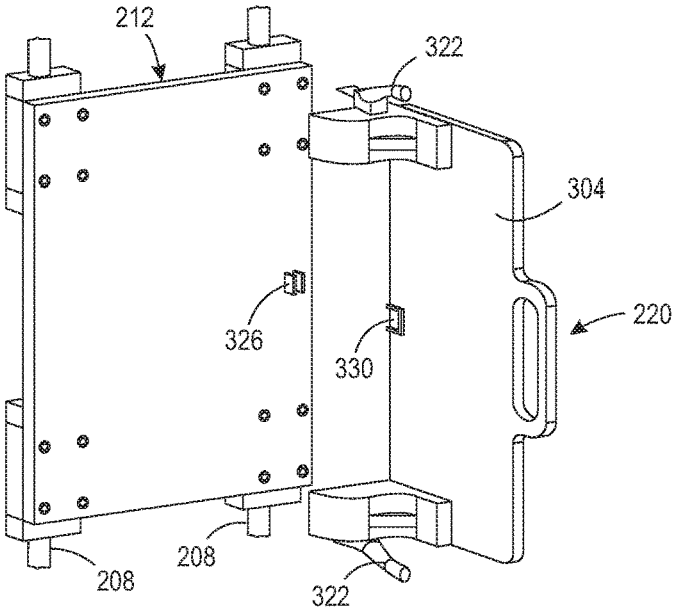

A perspective view of the object holder 220 is shown in FIG. 3B. In that figure, an identification tag 330 on a surface of the object holder 220 faces the input device 326 on the movably mounted member 212 when the holder is secured to the member 212. The input device 326 is operatively connected to the controller 224, shown in FIGS. 2A and 2B, to communicate an identifier from the identification tag 330 to the controller. The controller is further configured to operate the array of printheads 204 and the actuator 216 (FIGS. 2A and 2B) with reference to the identifier received from the input device 326 of the movably mounted member 212. As used in this document, "identification tag" means machine-readable indicia that embodies information to be processed by the printing system. The indicia can be mechanical, optical, or electromagnetic. In one embodiment, the identification tag 330 is a radio frequency identification (RFID) tag and the input device 326 of the movably mounted member is a RFID reader. In another embodiment, the identification tag 330 is a bar code and the input device 326 of the movably mounted member 212 is a bar code reader. In another embodiment in which mechanical indicia are used for the identification tag, the indicia are protrusions, indentations, or combinations of protrusions and indentations in a material that can be read by a biased arm following the surface of the identification tag. The input device 326 in such an embodiment can be a cam follower that converts the position of an arm that follows the mechanical features into electrical signals.

The controller 224 is further configured with programmed instructions stored in the memory 228 to compare the identifier received from the input device 326 of the movably mounted member 212 to identifiers stored in the memory 328 operatively connected to the controller. The controller disables operation of the actuator 216 in response to the identifier received from the input device 326 failing to correspond to one of the identifiers stored in the memory. In another embodiment, the controller 224 is further configured with programmed instructions stored in the memory 328 to compare the identifier received from the input device 326 of the movably mounted member 212 to identifiers stored in the memory 328. In this embodiment, the controller 224 disables operation of the printheads in the array of printheads 204 in response to the identifier received from the input device 326 failing to correspond to one of the identifiers stored in the memory 328. In some embodiments, the controller 224 is configured to disable both the actuator 216 and the array of printheads 204 in response to the identifier received from the input device 326 failing to match one of the identifiers stored in the memory 328.

Figure 2C:
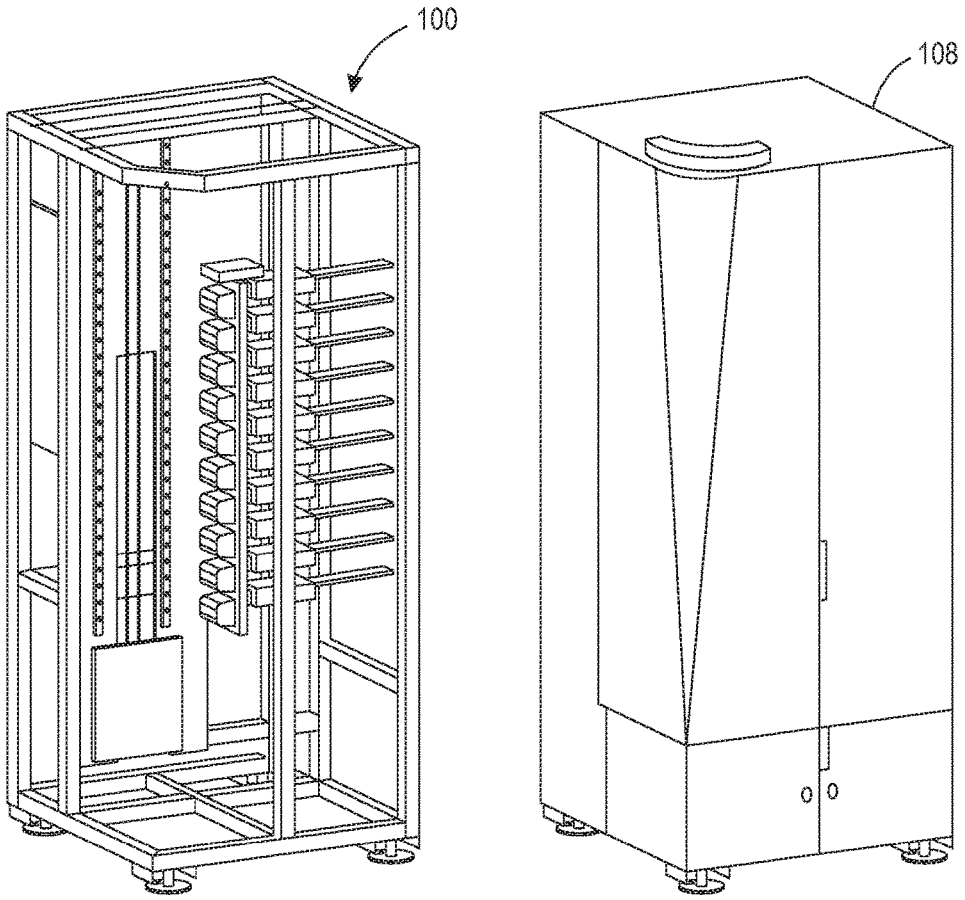
FIG. 2C depicts a cabinet within which one of the embodiments shown in FIG. 2A and FIG. 2B can be installed.

In all of these embodiments, the controller 224 is operatively connected to a user interface 350 as shown in FIG. 1, FIG. 2A, and FIG. 2B. The interface 350 includes a display 360, an annunciator 364, and an input device 368, such as a keypad. The controller 224 is configured with programmed instructions to operate the user interface to notify an operator of the failure of the identifier received from the input device 326 to correspond to one of the identifiers in memory. Thus, the operator is able to understand the reason for the disabling of the system. Additionally, the controller 224 is configured with programmed instructions to operate the user interface 350 to inform the operator of a system status that is incompatible with the identifier received from the input device 326. For example, the controller 224 monitors the system to detect the configuration of the printheads in the system and the inks being supplied to the printheads. If the inks or the printhead configuration is unable to print the objects corresponding to the object holder accurately and appropriately, then the user interface 350 is operated by the controller 224 to generate a message on the display 360 for the operator that inks need to be changed or that the printhead array needs to be reconfigured. The controller 224 is also configured with programmed instructions to operate the user interface 350 to inform the operator of processing that needs to be performed. For example, some identifiers received from the input device 326 indicate that an object requires pre-coating prior to printing or post-coating after the object is printed. The controller 224 in this example operates the user interface 350 to provide a message on the display 360 to the operator regarding either or both of the conditions. The user interface 350 includes a display 360 for alphanumeric messages, a keypad 368 for entry of data by an operator, and an annunciator 364, such as a warning light or audible alarm, to attract attention to displayed messages.

Figure 3C:
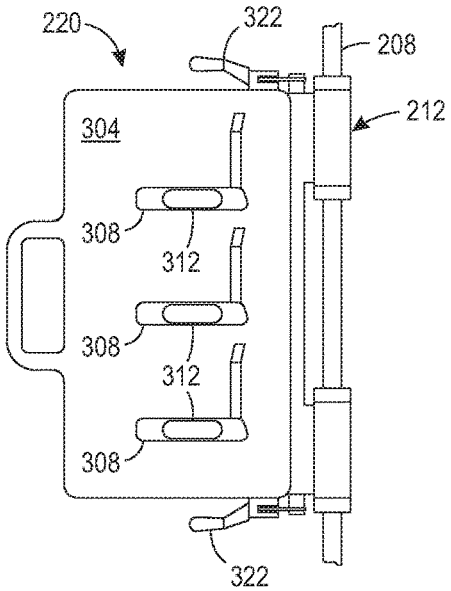
Figure 3D:
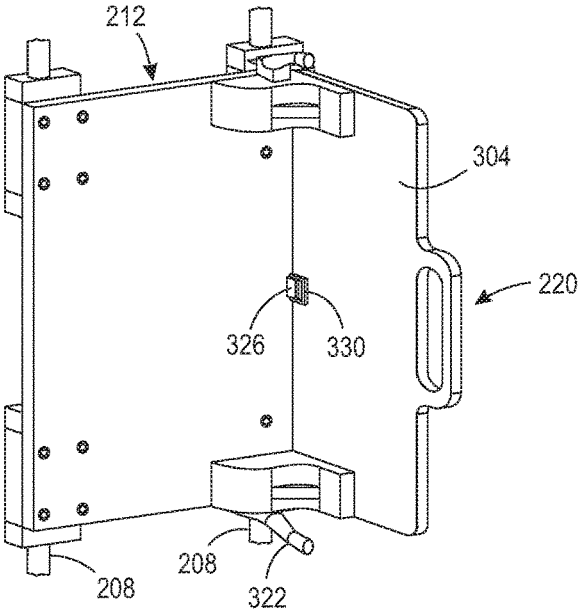

FIG. 3C shows a front view of the object holder 220 secured to the movably mounted member 212 and FIG. 3D shows a rear view of the object holder 220 to the moveably mounted member 212. Additionally, the controller 224 can be configured to accumulate a count of the number of times an object holder is mounted and dismounted to the movably mounted member 212. This count can be used to obtain and store a number of objects printed by the system 100. This count of printed objects can then be used to order supplies for the continued operation of the system before the supplies are exhausted or to render an accounting of the throughput of the system for various purposes.

Figure 4A:
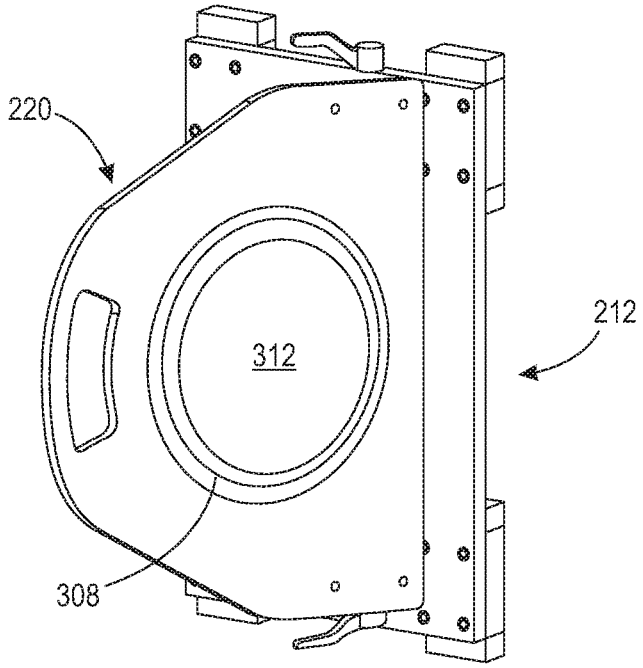
FIG. 4A to 4I depict various configurations of object holders shown in FIGS. 2A and 2B for holding different types of objects.
Figure 4B:
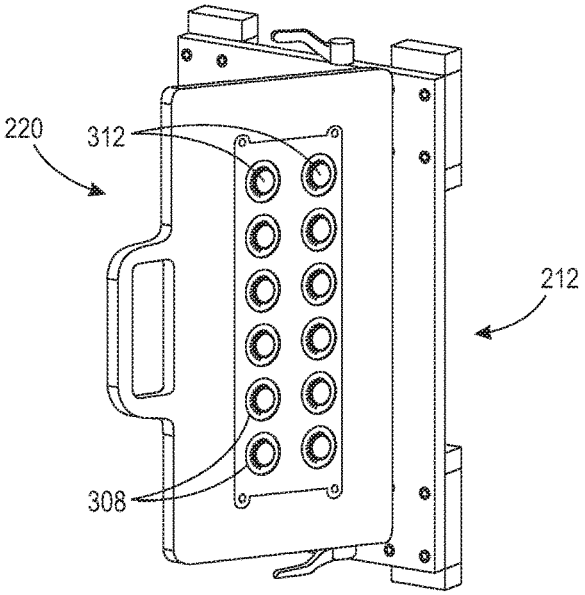
Figure 4C:
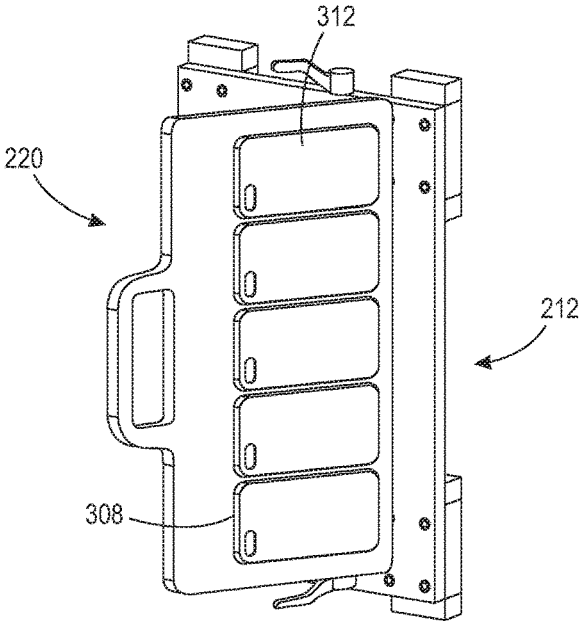
Figure 4D:
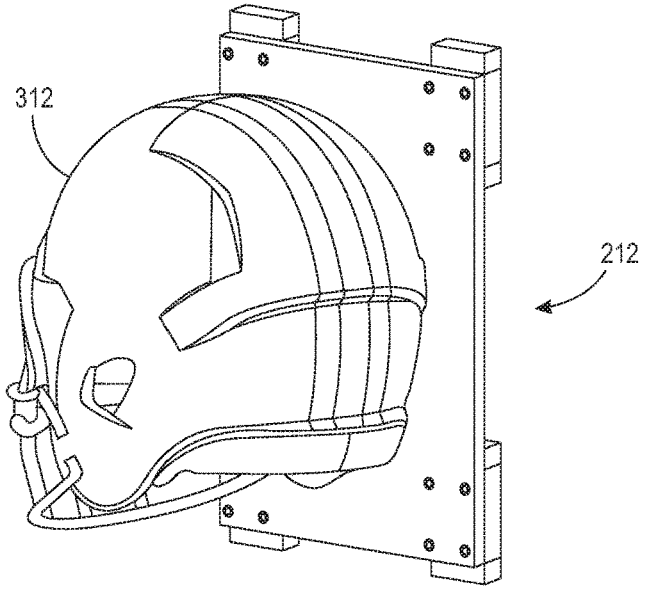
Figure 4E:
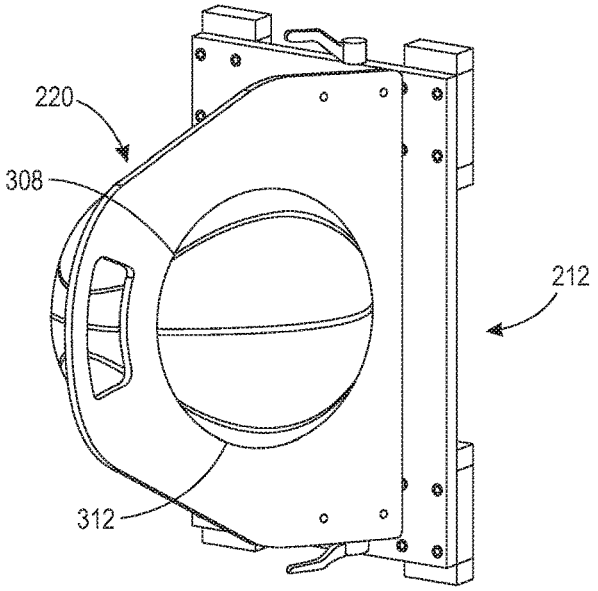
Figure 4F:
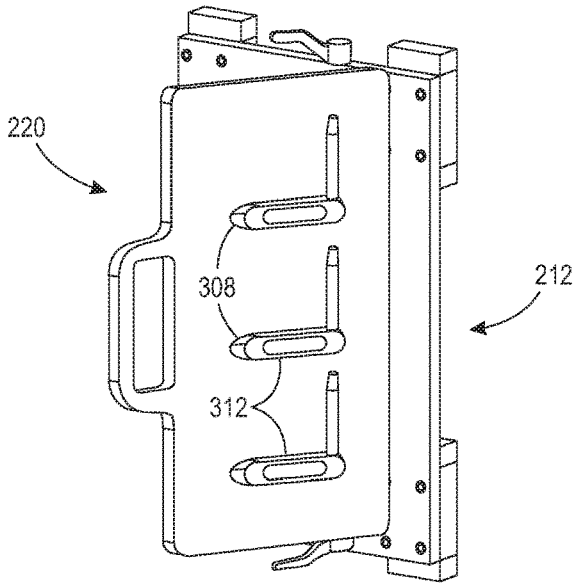
Figure 4G:
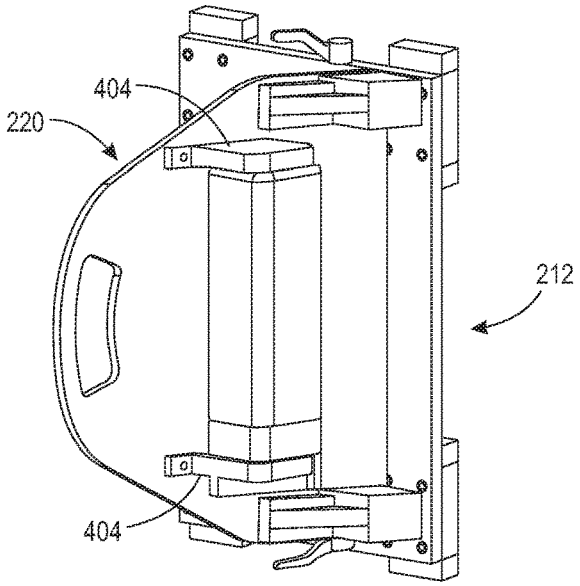
Figure 4H:
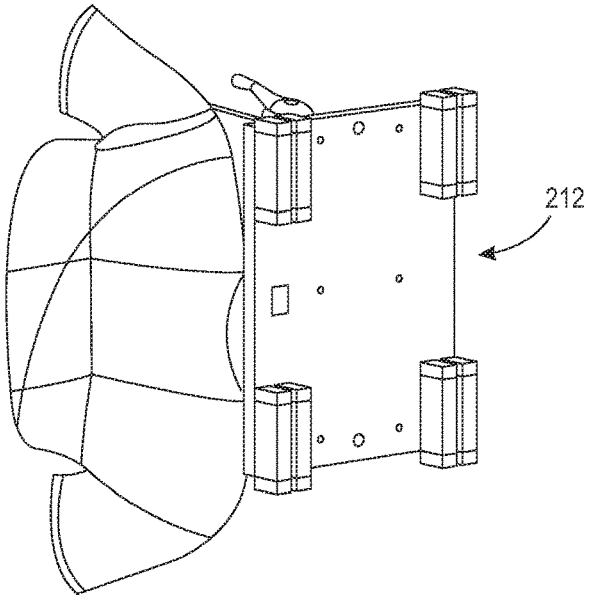
Figure 4I:
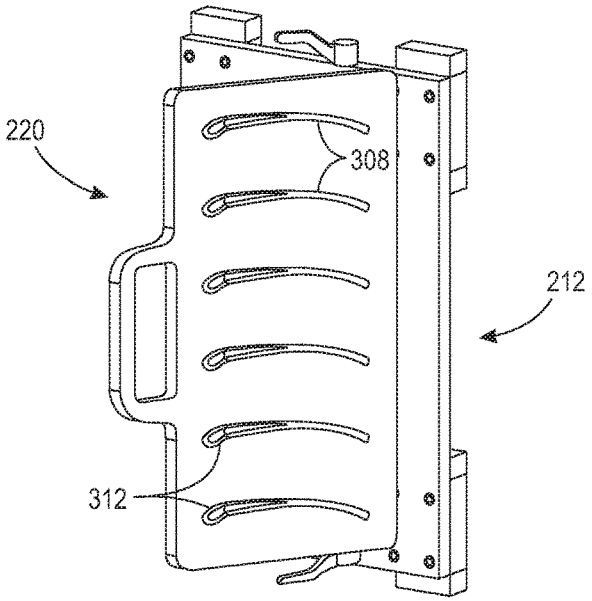

FIG. 4A through 4J depict object holders 220 in various configurations for holding different types of articles and the holders 220 are secured to the movably mounted member 212. The object holders in FIGS. 4A, 4B, 4C, 4E, 4G, and 4I include at least one aperture that is configured to hold an object for printing by the array of printheads. In FIG. 4A, the aperture 308 is configured to hold a disk-shaped object 312. In FIG. 4B, each aperture 308 in a plurality of apertures is configured to hold a plurality of cap-shaped objects 312. In FIG. 4C, each aperture 308 in a plurality of apertures is configured to hold a plurality of cases 312, such as the depicted mobile telephone cases. In FIG. 4E, the aperture 308 is configured to hold a spherically shaped object 312. In FIG. 4F, each aperture 308 in a plurality of apertures is configured to hold a golf club head 312. In FIG. 4I, each aperture 308 in a plurality of apertures is configured to hold an ear piece 312 of an eyeglasses frame. In FIG. 4D, the object holder (not visible) is configured to hold head gear. In FIG. 4G, the object holder 220 includes a pair of arms 404 configured to secure a rectangular or cylindrical object 312 between them. As used in this document, the term "arm" refers to a member having two ends with one end being mounted to the object holder and the remainder of the member is configured to hold the object with reference to the object holder. In FIG. 4H, the rear side of the moveably mounted member 212 is shown to depict the orientation at which an object holder (not visible) would hold an article of clothing to enable printing of a surface of the article.

Figure 5:
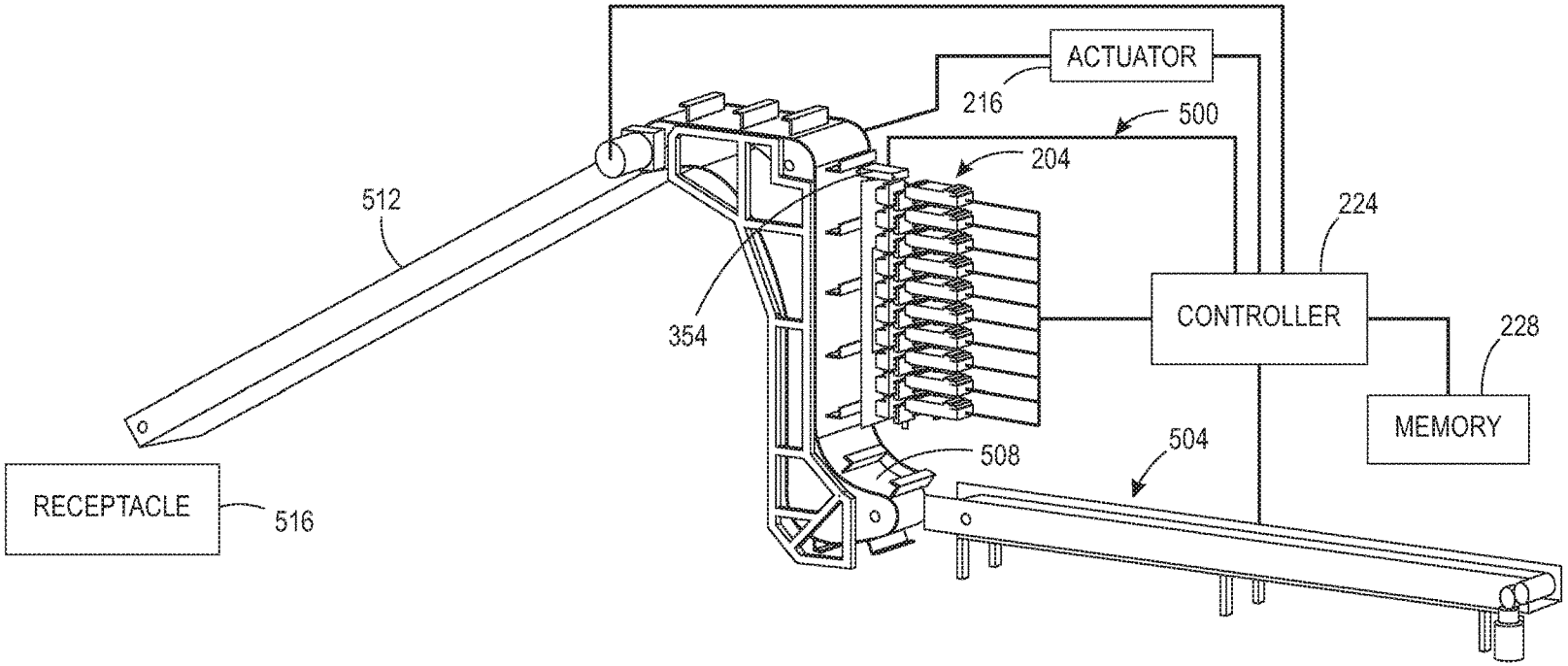
FIG. 5 depicts an embodiment of the system 100 that is useful in a manufacturing environment.

While the printing system 100 described above is especially advantageous in non-production environments, the system 500 depicted in FIG. 5 is more robust and useful in manufacturing environments. In system 500, a conveyor 504 is configured to deliver objects from a supply of objects (not shown) to an object holder 508. The object holder 508 is configured to receive objects from the conveyor 504. The controller 224 is operatively connected to the conveyor 504, the actuator 216, and the array of printheads 204. The controller 224 is further configured with programmed instructions stored in the memory 228 to operate the conveyor 504 to deliver objects to the object holders 508 and to operate the actuator 216 to move the objects held by the object holders past the array of printheads. This operation enables the printheads to print the objects as the objects pass the array of printheads 204. A bin can be provided to receive the objects from the object holders 508 after the objects have been printed. In another embodiment, another conveyor 512 is configured to receive objects from the object holders 508 after the objects held by the object holders are printed by the printheads in the array of printheads 204. The controller 224 is operatively connected to the conveyor 512 and operates the conveyor 512 to transport the printed objects to a location away from the printing system, such as a receptacle 516.

Figure 6A:
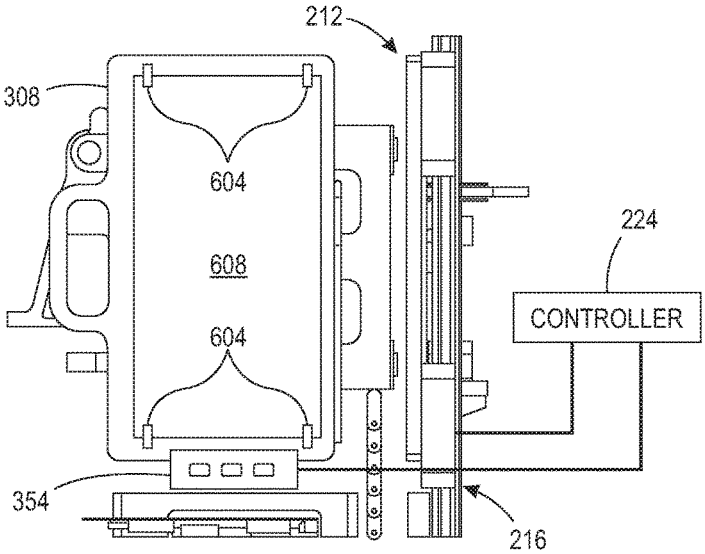
FIG. 6A depicts an embodiment of an object holder in the system of FIG. 1 that enables a media sheet to be printed with a test pattern to verify configuration of the system.
Figure 6B:
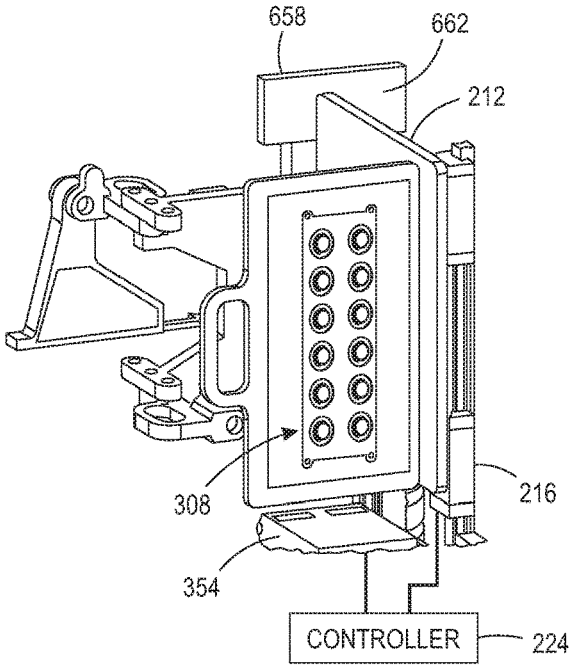
FIG. 6B depicts an embodiment of a member that is selectively attachable to an object holder in the system of FIG. 1 to enable a test pattern to be printed on a surface of the member to verify configuration of the system.

FIG. 6A illustrates shows the object holder 308 of FIG. 4C configured with biased members 604. The biased members can be resilient members formed with a crook at an unattached end of the member that presses downwardly on the surface of the holder 308. Portions of a sheet of media 608 can be inserted between the biased members and the surface of the holder 308 to enable the sheet to be held against the surface of the holder. An operator can initiate a test or setup mode through the input device of the user interface 350 once the media sheet is installed. In response, the controller 224 operates the actuator 216 to move the media sheet attached to the object holder past the printheads as the controller operates the printheads to eject one or more test patterns onto the media sheet. The system can include an optical sensor 354, such as a digital camera, that is positioned to generate image data of the test pattern and media sheet after the test pattern has been printed onto the sheet. The controller 224 executing programmed instructions analyzes the image data of the test pattern on the media sheet to identify maintenance issues, such as printhead alignments and inoperative ejectors within printheads. Additionally, the controller 224 verifies the system is appropriately configured to print the objects corresponding to the identifier received from the input device 326 that was read from the identification tag on the object holder. Alternatively, as depicted in FIG. 6B, an object holder, such as holder 308, can include a member 658 that is detachably mounted to the object holder and that has a test area 662. The test area 662 of the member 658 is a planar area of a material, such as Mylar, that can be printed by the system, imaged by the optical sensor 354, and analyzed by the controller 224 to identify issues with the configuration of the system.

The systems used in commercial environments print objects in non-production environments. Some of these objects can be quite expensive and the distributor does not want to waste objects by printing test patterns on them. Since some of these objects have curved or intricate geometries, forms replicated the shape and geometry of an object are provided for test runs through the system. These forms are shaped to conform to the general outline of the object, but are made from a material, such as Mylar or the like, that enable images to be printed on the form, imaged, and analyzed to identify maintenance issues or to verify the configuration of the system to print the objects. Once the system has been confirmed as being ready to print objects, the form can be removed and wiped clean so it can used at a later time. As an alternative to the form, a media sheet can be wrapped about an object so it can be printed and the image data analyzed without permanently forming an image on the object since the sheet can be removed before printing the object.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads arranged in a two-dimensional array, each printhead being configured to eject marking material;

a support member positioned to be in a plane parallel to a plane formed by the two-dimensional array of printheads;

a member mounted about the support member, the member being configured to move along the support member;

an actuator operatively connected to the member to enable the actuator to move the member along the support member;

an object holder having a latch configured for selectively mounting the object holder to the movably mounted member at a right angle to the support member to enable the object holder to move in the plane parallel to the plane formed by the two-dimensional array of printheads and an identification tag on a surface of the object holder that faces the movably mounted member, the object holder being configured to mount to the movably mounted member selectively to enable another surface of the object holder configured to hold at least one object to be parallel to the plane formed by the two-dimensional array of printheads as the movably mounted member moves along the support member;

an input device on the movably mounted member, the input device being configured to obtain an identifier from the identification tag on the object holder; and a controller operatively connected to the plurality of printheads, the input device of the movably mounted member, and the actuator, the controller being configured to operate the actuator with reference to the identifier received from the input device of the movably mounted member to move the other surface of the object holder past the two-dimensional array of printheads in the plane parallel to the plane formed by the two-dimensional array of printheads and to operate the plurality of printheads with reference to the identifier received from the input device of the movably mounted member to eject marking material onto the at least one object held by the object holder as the object holder moves past the two-dimensional array of printheads in the plane parallel to the plane formed by the two-dimensional array of printheads.

2. The printing system of claim 1 further comprising:

a belt that contacts a pair of pulleys, one of the pulleys in the pair of pulleys being operatively connected to the actuator to enable the actuator to rotate the one pulley to move the belt about the pair of pulleys and move the object holder past the array of printheads.

3. The printing system of claim 2 wherein the pair of pulleys are fixedly positioned and the belt is entrained about the pair of pulleys to form an endless belt; and the moveably mounted member includes a third pulley that engages the endless belt to enable the third pulley to rotate in response to the movement of the endless belt moving about the pair of pulleys to move the moveably mounted member.

4. The printing system of claim 1 wherein the actuator is a linear actuator that vertically moves the moveably mounted member bi-directionally.

5. The printing system of claim 1 wherein the support member is oriented to enable one end of the support member to be at a higher gravitational potential than a second end of the support member.

6. The printing system of claim 1 wherein the identification tag is a radio frequency identification (RFID) tag and the input device of the movably mounted member is a RFID reader.

7. The printing system of claim 1 wherein the identification tag is a bar code and the input device of the movably mounted member is a bar code reader.

8. The printing system of claim 1, the controller being further configured to:

compare the identifier received from the input device of the movably mounted member to identifiers stored in a memory operatively connected to the controller; and disable operation of the actuator in response to the identifier received from the input device failing to correspond to one of the identifiers stored in the memory.

9. The printing system of claim 1, the controller being further configured to:

compare the identifier received from the input device of the movably mounted member to identifiers stored in a memory operatively connected to the controller; and disable operation of the printheads in the array of printheads in response to the identifier received from the input device failing to correspond to one of the identifiers stored in the memory.

10. The printing system of claim 1, the controller being further configured to:

compare the identifier received from the input device of the movably mounted member to identifiers stored in a memory operatively connected to the controller; and operate a user interface to send a message regarding a status of the printing system.

11. The printing system of claim 10, the controller being further configured to:

monitor the system to detect a configuration of the printheads in the array of printheads and inks being supplied to the printheads; and operate the user interface to generate a message that inks need to be changed or that the array of printheads need to be reconfigured.

12. The printing system of claim 10, the user interface further comprising:

a display for alphanumeric messages;

a keypad for entry of data by an operator; and an annunciator to attract attention to messages on the display.

13. The printing system of claim 1, the object holder further comprising:

at least one aperture, the at least one aperture being configured to hold an object for printing by the array of printheads.

14. The printing system of claim 1, the object holder further comprising:

at least one arm, the at least one arm being configured to hold an object for printing by the array of printheads.

15. The printing system of claim 1 further comprising:

a conveyor configured to deliver objects from a supply of objects to the object holder;

the object holder is configured to receive objects from the conveyor; and the controller is operatively connected to the conveyor, the controller is further configured to operate the conveyor to deliver objects to the object holder for movement of the objects held by the object holder past the array of printheads to enable printing on the objects as the objects pass the array of printheads.

16. The printing system of claim 15 further comprising:

another conveyor configured to receive objects from the object holder after the objects held by the object holder are printed by the printheads in the array of printheads and transport the printed objects to a location away from the printing system.

17. A printing system comprising:

a plurality of printheads arranged in a two-dimensional array, each printhead being configured to eject marking material;

a support member positioned to be in a plane parallel to a plane formed by the two-dimensional array of printheads;

a member mounted about the support member, the member being configured to move along the support member;

an actuator operatively connected to the member to enable the actuator to move the member along the support member;

an object holder configured to mount to the member selectively to enable a surface of the object holder to be parallel to the plane formed by the two-dimensional array of printheads as the member moves along the support member;

biased members mounted to the object holder, the biased members being configured to press against the surface of the object holder to enable portions of a sheet of media to be held against the surface of the holder;

an optical sensor positioned to generate image data of the media sheet held against the surface of the holder; and a controller operatively connected to the plurality of printheads, the optical sensor, and the actuator, the controller being configured to:

operate the actuator to move the media sheet attached by the biased members to the surface of the object holder past the two-dimensional array of printheads in the plane parallel to the plane formed by the two-dimensional array of printheads;

operate the array of printheads to eject marking material onto the media sheet held by the biased members to the surface of the object holder as the object holder moves past the two-dimensional array of printheads in the plane parallel to the plane formed by the two-dimensional array of printheads to form one or more test patterns on the media sheet on the surface of the object holder; and analyze the image data of the one or more test patterns on the media sheet to identify printhead alignments and inoperative ejectors within the printheads in the array of printheads.

18. The printing system of claim 17 further comprising:

a user interface configured to generate and display alphanumeric messages.

19. The printing system of claim 18, the user interface further comprising:

a display configured to display the alphanumeric messages;

a keypad for entry of data by an operator; and an annunciator to attract attention to the alphanumeric messages on the display.

20. A printing system comprising:

a plurality of printheads arranged in a two-dimensional array, each printhead being configured to eject marking material;

a support member positioned to be in a plane parallel to a plane formed by the two-dimensional array of printheads;

a member mounted about the support member, the member being configured to move along the support member;

an actuator operatively connected to the member to enable the actuator to move the member along the support member;

an object holder configured to mount to the member selectively to enable a surface of the object holder configured to hold at least one object to be parallel to the plane formed by the two-dimensional array of printheads as the member moves along the support member;

a member detachably mounted to the object holder, the member including a planar area of a material that can be printed by the system;

an optical sensor positioned to generate image data of the planar area of the detachably mounted member; and a controller operatively connected to the array of printheads, the optical sensor, and the actuator, the controller being configured to:

operate the actuator to move the object holder and the detachably mounted member past the two-dimensional array of printheads in the plane parallel to the plane formed by the two-dimensional array of printheads;

operate the array of printheads to eject marking material onto the planar area of the detachably mounted member as the object holder moves past the two-dimensional array of printheads in the plane parallel to the plane formed by the two-dimensional array of printheads to form one or more test patterns on the planar area of the detachably mounted member as the object holder moves past the array of printheads; and analyze the image data of the one or more test patterns on the planar area to identify printhead alignments and inoperative ejectors within the printheads in the array of printheads.

21. A printing system comprising:

a plurality of printheads arranged in a two-dimensional array, each printhead being configured to eject marking material;

a support member positioned to be in a plane parallel to a plane formed by the two-dimensional array of printheads;

a member mounted about the support member, the member being configured to move along the support member;

an actuator operatively connected to the member to enable the actuator to move the member along the support member;

an object holder configured to mount to the member selectively to enable a surface of the object holder configured to hold at least one object to be parallel to the plane formed by the two-dimensional array of printheads as the member moves along the support member;

an optical sensor positioned to generate image data of the object held by the object holder after the object has passed the array of printheads; and a controller operatively connected to the plurality of printheads, the optical sensor, and the actuator, the controller being configured to:

operate the actuator to move the detachably mounted member and the object holder and the object past the two-dimensional array of printheads in the plane parallel to the plane formed by the two-dimensional array of printheads;

operate the array of printheads to eject marking material onto the object held by the object holder as the object holder moves past the two-dimensional array of printheads in the plane parallel to the plane formed by the two-dimensional array of printheads to form one or more test patterns on the object as the object holder moves past the array of printheads; and analyze the image data of the one or more test patterns on the object to identify printhead alignments and inoperative ejectors within the printheads in the array of printheads.

* * * * *